US008513170B2

(12) United States Patent
Kato et al.

(10) Patent No.: US 8,513,170 B2
(45) Date of Patent: Aug. 20, 2013

(54) SOLID LUBRICANT AND PRODUCTION METHOD THEREOF

(75) Inventors: Masanori Kato, Tokyo (JP); Hiroshi Idei, Tokyo (JP); Akinori Hashimoto, Tokyo (JP)

(73) Assignee: Akebono Brake Industry Co., Ltd., Tokyo (JP)

( * ) Notice: Subject to any disclaimer, the term of this patent is extended or adjusted under 35 U.S.C. 154(b) by 94 days.

(21) Appl. No.: 12/905,443

(22) Filed: Oct. 15, 2010

(65) Prior Publication Data

US 2011/0092400 A1 Apr. 21, 2011

(30) Foreign Application Priority Data

Oct. 16, 2009 (JP) ..... 2009-239431
Jun. 18, 2010 (JP) ..... 2010-139312

(51) Int. Cl.
*C10M 103/02* (2006.01)

(52) U.S. Cl.
USPC ..... 508/113; 508/109; 508/128

(58) Field of Classification Search
USPC ..... 508/109, 128, 113
See application file for complete search history.

(56) References Cited

U.S. PATENT DOCUMENTS

| | | | | |
|---|---|---|---|---|
| 3,836,466 | A | 9/1974 | Abe et al. | |
| 5,294,355 | A | 3/1994 | King et al. | |
| 5,759,622 | A * | 6/1998 | Stover | 427/249.15 |
| 2006/0008647 | A1 * | 1/2006 | Walker et al. | 428/408 |

FOREIGN PATENT DOCUMENTS

| | | |
|---|---|---|
| DE | 10 2004 045 128 A1 | 3/2006 |
| JP | 4-254486 | 9/1992 |
| JP | 2001-106585 | 4/2001 |

OTHER PUBLICATIONS

Lu et al., Oxidation protection of carbon materials by acid phosphate impregnation, Oct. 2001.*

Weiming Lu et al., "Oxidation protection of carbon materials by acid phosphate impregnation", Carbon, vol. 40, No. 8, Jul. 1, 2002, pp. 1249-1254, XP004357622.

A. P. Wieber et al., "An STM study of phosphoric acid inhibition of the oxidation of HOPG and carbon catalyzed by alkali salts", Carbon, vol. 44, No. 10, Aug. 1, 2006, pp. 2069-2079, XP025011174.

T. L. Dhami et al., "Oxidation-Resistant Carbon-Carbon Composites Up to 1700° C", Carbon, vol. 33, No. 4, Jan. 1, 1995, pp. 479-490, XP004022551.

Andrea Kalendova et al., "Anticorrosion properties of polyaniline-coated pigments in organic coatings", Corrosion Science, vol. 50, No. 12, Dec. 1, 2008, pp. 3549-3560, XP025711002.

* cited by examiner

*Primary Examiner* — Taiwo Oladapo
(74) *Attorney, Agent, or Firm* — Drinker Biddle & Reath LLP

(57) ABSTRACT

A method for producing a solid lubricant includes steps of preparing and coating. A phosphate aqueous solution prepared by the step of preparing is an aqueous solution containing at least one of aluminum dihydrogen phosphate and magnesium dihydrogen phosphate in an amount of 0.5 to 10% by mass. A graphite material is coated with a phosphate using the phosphate aqueous solution. The graphite material is used at a ratio of 40 to 50 parts by mass based on 100 parts by mass of the aqueous solution.

6 Claims, 3 Drawing Sheets

×100,000

×100,000

SOLID LUBRICANT AND PRODUCTION METHOD THEREOF

RELATED APPLICATION

This application claims priority from Japanese Patent Application No. 2010-319312, filed Jun. 18, 2010 and Japanese Patent Application No. 2009-239431, filed Oct. 16, 2009, which are incorporated by reference in its entirety.

BACKGROUND

The present invention relates to a solid lubricant, a production method thereof, a non-asbestos brake friction material, and a sliding component using the solid lubricant. More particularly, the invention relates to a solid lubricant more significantly improved in thermal resistance and oxidation resistance than graphite and enhanced in lubricating performance at high temperature, an effective production method thereof, a non-asbestos brake friction material, and a sliding component using the above-mentioned solid lubricant.

Layered materials such as graphite and molybdenum disulfide and organic materials such as polytetrafluoroethylene (PTFE) are used as solid lubricants in non-asbestos brake friction materials and the other sliding fields. Further, ceramic-treated products of graphite such as C/C composite improved in oxidation resistance and thermal resistance (see Patent Document 1) also begin to be utilized.

However, the non-asbestos brake friction materials are also not sufficiently satisfactory in lubricating characteristics in a high-temperature range of 500° C. or more in the atmosphere. Therefore, the occurrence of wear and abnormal noise are leaded. Accordingly, development of solid lubricants having satisfactory lubricating characteristics in the high-temperature range has become a problem.

By the way, a technique for improving oxidation resistance of graphite by a phosphoric acid or phosphate treatment is a technique widely used in refractories or glosts. However, this is quite irrelevant to improvement of graphite in lubricating characteristics, and is not a technique applied to the solid lubricants.

On the other hand, it has been confirmed that graphite particles treated with aluminum phosphate are improved in wear resistance. However, the lubricating characteristics have not been sufficiently satisfactory in a high-temperature range of 500° C. or more in the atmosphere.

Further, many attempts to coat surfaces of carbon material with SiC (silicon carbide) covering layers excellent in thermal resistance and oxidation resistance have hitherto been made. However, cracks occur in the covering layers due to the difference in thermal expansion between carbon and the ceramic, so that it has been impossible to expect a stable effect. Patent Document 2 proposes a method of implanting boron ions in a surface of a carbon material by a plasma immersion ion-implantation method, thereby forming a modifying layer containing boron carbide to improve adhesiveness of the carbon material, and further forming a SiC covering layer by a CVD method, thereby improving oxidation resistance of the carbon material in a high-temperature range. However, there is no description for a use as a friction material, so that it is unthinkable that this method can be necessarily applied to the friction material.

[Patent Document 1] Japanese Patent Publication Number 4-254486

[Patent Document 2] Japanese Patent Publication Number 2001-106585

SUMMARY

It is therefore an object of the present invention to provide a solid lubricant, in which more significantly improved in thermal resistance and oxidation resistance than graphite and enhanced in lubricating performance at high temperature. Another object of the present invention is to provide a method for efficiently producing the solid lubricant. Another object of the present invention is to provide a non-asbestos brake friction material and a sliding component using the above-mentioned solid lubricant.

In order to achieve the above object, according to the present invention, there is provided a solid lubricant comprising a graphite material coated with a phosphate.

The solid lubricant may be configured such that the phosphate is at least one selected from the group consisting of an aluminum phosphate, a magnesium phosphate, a calcium phosphate, a potassium phosphate, a sodium phosphate and a zinc phosphate.

The solid lubricant may be configured such that the graphite material coated with the phosphate has a phosphate covering layer having a thickness of 5 to 500 nm on a particle surface thereof.

The solid lubricant may be configured such that the graphite material is previously pretreated by a wet method or a dry method.

The solid lubricant may be configured such that the pretreatment by the wet method is a washing treatment with an acid.

The solid lubricant may be configured such that the pretreatment by the dry method is an atmospheric plasma treatment.

According to the present invention, there is also provided a method for producing a solid lubricant by coating a graphite material with a phosphate using a phosphate aqueous solution, wherein the phosphate aqueous solution contains at least one of aluminum dihydrogen phosphate and magnesium dihydrogen phosphate in an amount of 0.5 to 10% by mass, and the graphite material is used at a ratio of 40 to 50 parts by mass based on 100 parts by mass of the aqueous solution.

In the method, the graphite material may be previously pretreated by a wet method or a dry method.

In the method, the pretreatment by the wet method may be a washing treatment with an acid, In the method, the pretreatment by the dry method may be an atmospheric plasma treatment.

According to the present invention, there is also provided a non-asbestos brake friction material comprising the solid lubricant as described in any one of the above solid lubricant.

According to the present invention, there is also provided a sliding component comprising the solid lubricant as described in any one of the above solid lubricant.

DETAILED DESCRIPTION OF EXEMPLIFIED EMBODIMENTS

In order to achieve the above-mentioned objects, the present inventors have made intensive studies. As a result, it has been found that a solid lubricant having the above-mentioned properties is obtained by coating a graphite powder, preferably a graphite powder previously pretreated by a wet method or a dry method, with a phosphate aqueous solution under specific conditions, thus being able to achieve the objects. Based on this finding, the invention has been completed.

First, the solid lubricant of the invention will be described.

The solid lubricant of the invention is characterized in that the graphite material is coated with the phosphate.

It is preferred that the graphite material used as a raw material for the above-mentioned solid lubricant is previously pretreated by the wet method or the dry method, from the viewpoint of improving thermal resistance and oxidation resistance of the solid lubricant comprising the graphite material coated with the phosphate.

As the pretreatment of the graphite material by the wet method, there can be used, for example, acid cleaning, anodizing or the like. In the case of the acid cleaning, specifically, phosphoric acid having a concentration of 85% by mass is used as the acid, and added in an amount of about 1 to about 5 parts by mass based on part by mass of the graphite material to perform the acid cleaning at an temperature of about 40 to about 60° C. for about 1 to about 10 minutes. The graphite material after the acid cleaning is thoroughly washed with water, and then, subjected to the surface treatment with the phosphate.

As the acid used in the acid cleaning, phosphoric acid is used from the aspects of function and environment. However, sulfuric acid, nitric acid or the like can also be used.

On the other hand, in the case of the anodizing, specifically, a sulfuric acid bath or the like is used, and a voltage of about 4 to about 8 V is applied to electrodes to perform the anodizing at a bath temperature of about 0 to about 10° C. for about 20 to about 50 seconds. The graphite material after the anodizing is thoroughly washed with water, and then, subjected to the surface treatment with the phosphate.

In the invention, the acid cleaning is used from the aspect of simplicity of apparatus and operation.

As the pretreatment of the graphite material by the dry method, there can be used, for example, an atmospheric plasma treatment, a heating treatment, a microwave irradiation treatment or the like. In the case of the atmospheric plasma treatment, the treatment is performed by irradiating the graphite material with plasma using an atmospheric plasma generator.

Figure 1:
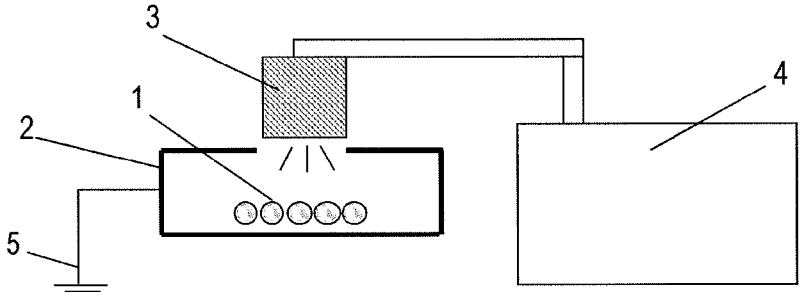
FIG. 1 is an explanatory view showing one embodiment of plasma irradiation used in a pretreatment of a graphite material.

FIG. 1 is an explanatory view showing one embodiment of plasma irradiation and shows a state where plasma 3 generated from a plasma generator 4 is irradiated to graphite particles 1 contained in a vessel 2. Incidentally, reference numeral 5 denotes a ground.

A plasma treatment method is not particularly limited, as long as it is a method which can irradiate the graphite particles with plasma. The atmospheric plasma method of generating discharge plasma by applying a high-frequency voltage between electrodes facing to each other desirably at atmospheric pressure or pressure near to atmospheric pressure is simple and effective. The distance between a plasma generating source and the graphite particles is from 20 to 30 mm. The distance can be also from 10 to 50 mm. The treating time may be from 60 to 120 seconds. The treating time can be also from 30 to 180 seconds. The graphite particles are pneumatically blown away at the time of plasma irradiation, so that as the vessel, there may be used a vessel having a hole only at a portion which is irradiated with the plasma.

In the case of the heating treatment, specifically, the heating treatment is performed in an air atmosphere at a temperature of about 600 to about 1,000° C. for about 1 to about 5 hours.

On the other hand, in the case of the microwave irradiation treatment, a microwave oven can be used. When the microwave oven is used, for example, a voltage of 550 V is applied to perform the irradiation treatment for about 10 to about 60 seconds.

In the invention, the atmospheric plasma treatment is used in terms of the effect.

As the graphite material used as the raw material in the solid lubricant of the invention, the various graphite materials described above may be used as they are, or the graphite material previously pretreated by the wet method or the dry method as described above may be used. From the viewpoint of the performance of the resulting solid lubricant comprising the graphite material coated with the phosphate, the previously pretreated graphite material is used.

In the solid lubricant of the invention, a metal constituting the phosphate coated on the graphite material may be a metal belonging to Group 1, Group 2, Group 12 or Group 13 of the Periodic Table (Long Form). Specifically, examples include Na and K belonging to Group 1; Mg belonging to Group 2; Zn belonging to Group 12; and Al belonging to Group 13. The phosphates used for coating the graphite material include, for example, at least one selected from an aluminum phosphate, a magnesium phosphate, a calcium phosphate, a potassium phosphate, a sodium phosphate and a zinc phosphate. These phosphates are preferably hydrogen phosphates from the viewpoints of water solubility and pH.

For example, the aluminum phosphates include aluminum dihydrogen phosphate [$Al(H_2PO_4)_3$] and aluminum hydrogen phosphate [$Al_2(HPO_4)_3$], the magnesium phosphates include magnesium hydrogen phosphate [$MgHPO_4$] and magnesium dihydrogen phosphate [$Mg(H_2PO_4)_2$], the calcium phosphates include calcium dihydrogen phosphate [$Ca(H_2PO_4)_2$], calcium hydrogen phosphate [$CaHPO_4$], tricalcium phosphate [$Ca_3(PO_4)_2$] and zinc calcium phosphate [$Zn_2Ca(PO_4)_2$], the potassium phosphates include potassium dihydrogen phosphate [$KH_2PO_4$] and dipotassium hydrogen phosphate [$K_2HPO_4$], the sodium phosphates include sodium dihydrogen phosphate [$NaH_2PO_4$] and disodium hydrogen phosphate [$Na_2HPO_4$], and the zinc phosphates include zinc hydrogen phosphate [$ZnHPO_4$] and zinc dihydrogen phosphate [$Zn(H_2PO_4)_2$].

These hydrogen phosphates may be used either alone or in combination of two or more thereof. In the invention, of these, aluminum dihydrogen phosphate and magnesium dihydrogen phosphate are used. And particularly, aluminum dihydrogen phosphate is suitable from the viewpoint of the performance.

A method for coating the graphite material with the phosphate by using the above-mentioned hydrogen phosphate will be described in the following production method of a solid lubricant according to the invention.

The graphite material thus coated with the phosphate has a phosphate covering layer having a thickness of usually 20 to 100 mm on a particle surface thereof. The thickness can be about 5 to about 500 nm. As a result, the solid lubricant more significantly improved in thermal resistance and oxidation resistance than graphite and enhanced in lubricating performance at high temperature is obtained.

The production method of a solid lubricant according to the invention will be described below.

The solid lubricant of the invention comprises the graphite material coated with the phosphate as described above. As the phosphate, the hydrogen phosphate is used, and particularly, aluminum dihydrogen phosphate and/or magnesium dihydrogen phosphate are used.

Accordingly, in the production method of the solid lubricant according to the invention, aluminum dihydrogen phosphate and/or magnesium dihydrogen phosphate described above, which are suitable, are used as the phosphate. That is to say, this production method is a method for producing the solid lubricant by coating the graphite material with the phosphate using a phosphate aqueous solution. In the production method, the phosphate aqueous solution is an aqueous solution containing aluminum dihydrogen phosphate and/or magnesium dihydrogen phosphate in an amount of 0.5 to 10% by mass, and that the graphite material is used at a ratio of 40 to 50 parts by mass based on 100 parts by mass of the aqueous solution.

Specifically describing this production method, the aqueous solution containing aluminum dihydrogen phosphate and/or magnesium dihydrogen phosphate in an amount of 0.5 to 10% by mass is first prepared. In the preparation of this aqueous solution, when aluminum dihydrogen phosphate is used, the concentration of the aqueous solution is from 1 to 5% by mass. The concentration can be also from 0.5 to 10%. On the other hand, when magnesium dihydrogen phosphate is used, the concentration of the aqueous solution is preferably from 0.5 to 10% by mass, more preferably from 0.5 to 5% by mass, and still more preferably from 1 to 5% by mass.

Then, the above-mentioned graphite material is added at a ratio of 40 to 50 parts by mass to 100 parts by mass of the hydrogen phosphate aqueous solution thus prepared, and mixing by stirring is conducted, for example, with a planetary ball mill, a rotary vane stirrer or the like. Rotary vane type stirring is preferred as a simple process. The temperature of the aqueous solution at the time of stirring is from 40 to 50° C., The temperature can be from 25 to 60° C., and can also be from 10 to 80° C. Subsequently, this mixture is dried in the normal atmosphere and then cracked, followed by heat treatment at a temperature of about 500 to about 800° C. in a reduced pressure of about 100 to about 500 Pa for about 1 to about 5 hours, thereby being able to obtain the solid lubricant of the invention having the phosphate covering layer with a thickness of about 20 to about 100 nm on the particle surface. The thickness can be about 5 to about 500 nm.

The solid lubricant of the invention thus obtained is significantly improved in thermal resistance and oxidation resistance compared to an untreated graphite material and has high lubricating performance at high temperature, Accordingly, such a solid lubricant is suitably used in a non-asbestos brake friction material or a sliding component.

The non-asbestos brake friction material and the sliding component of the invention will be described below.

The non-asbestos brake friction material of the invention comprises the above-mentioned solid lubricant of the invention.

The non-asbestos brake friction material of the invention can be obtained by performing forming according to a conventional method by using a friction-material-forming material comprising a binder resin, the solid lubricant of the invention described above, a fibrous reinforcing material, a friction adjusting material and a filler.

There is no particular limitation on the binder resin used in the friction-material-forming material, and any resin can be appropriately selected to use from well-known thermosetting resins which have hitherto been known as binder resins in non-asbestos brake friction materials, for example, phenol resins, epoxy resins and polybenzoxazine resins.

As the solid lubricant used in the friction-material-forming material, the solid lubricant of the invention described above is used as an essential component. Further, any one can be appropriately selected to use together from well-known ones which have hitherto been used as lubricants in friction materials, as needed. Specific examples of the lubricants include graphite, graphite fluoride, carbon black, metal sulfides such as tin sulfide and tungsten disulfide, PTFE and boron nitride. These may be used either alone or in combination of two or more thereof.

As the fibrous reinforcing material used in the friction-material-forming material, either of organic fibers and inorganic fibers can be used. The organic fibers include high strength aromatic polyamide fibers (for example, aramid fibers such as "Kevlar" (trade name) manufactured by Du Pont), flame-resistant acrylic fibers, polyimide fibers, polyacrylate fibers and polyester fibers. On the other hand, the inorganic fibers include ceramic fibers such as alumina silica-based fibers, and metal fibers such as stainless steel fibers, copper fibers, brass fibers, nickel fibers and iron fibers, as well as potassium titanate fibers, basalt fibers, silicon carbide fibers, glass fibers, carbon fibers and wollastnite fibers. These fibrous substances may be used alone or in combination of two or more thereof.

Further, there is no particular limitation on the friction adjusting material used in the friction-material-forming material, and any one can be appropriately selected to use from well-known ones which have hitherto been known as friction adjusting materials in friction materials. Specific examples of the friction adjusting materials include metal oxides such as magnesia and iron oxide; zirconium silicate; carbon silicate; inorganic friction adjusting materials such as metal powders, for example, copper, brass, zinc and iron, and titanate powder; and organic friction adjusting materials such as NBR, SBR and rubber dust, for example, tire tread rubber, and organic dust such as cashew dust. These may be used alone or in combination of two or more thereof.

In the friction-material-forming material, a swelling clay mineral can be allowed to be contained as the filler. The swelling clay minerals include, for example, kaolin, talc, smectite, vermiculite and mica.

Further, calcium carbonate, barium sulfate, calcium hydroxide or the like can be allowed to be contained.

Incidentally, in the friction-material-forming material, when an inorganic filler is used among the above-mentioned fillers, a filler treated with an organic compound can be used in order to improve dispersibility into the material.

The fillers treated with organic compounds include, for example, calcium carbonate, barium sulfate, magnesia, aluminum powder, zinc powder, graphite, zinc sulfide and tungsten disulfide, including swelling clay minerals, which are treated with organic compounds.

In preparing the friction material of the invention, the above-mentioned friction-material-forming material is filled in a die or the like, preformed at ordinary temperature under a pressure of about 5 to about 30 MPa, and then, subjected to heat and pressure forming under conditions of a temperature of about 130 to about 190° C. and a pressure of about 10 to about 100 MPa for about 5 to about 35 minutes, followed by heat treatment at a temperature of about 160 to about 270° C. for about 1 to about 10 hours as needed, thereby being able to prepare the desired friction material.

The friction material of the invention thus prepared is improved in wear resistance in the high-temperature range to lengthen the product life.

Further, the sliding component of the invention comprises the above-mentioned solid lubricant of the invention. The sliding component suits for an opposite material for cast iron. Such sliding components include, for example, ones for automobiles such as passenger cars and two-wheeled vehicles.

The invention will be described in more detail below with reference to Examples, but the invention is not to be construed as being limited thereby in any way.

EXAMPLE 1

Aluminum dihydrogen phosphate was dissolved in pure water to prepare an aqueous solution having a concentration of 1% by mass. To 100 parts by mass of this aqueous solution, 42 parts by mass of artificial graphite (manufactured by Tokai Carbon Co., Ltd., trade name: "G152A", average particle size: 700 μm) was added, followed by stirring at a temperature of 50° C. for 1 hour by using a rotary vane stirrer (manufactured by AS ONE Corporation, model name: "PM-203").

The resultant mixture was dried in the atmosphere for 24 hours and cracked, followed by heat treatment in vacuum at 800° C. for 3 hours. After the heat treatment, the cracked mixture was pulverized in a mortar to obtain a solid lubricant of Example 1 comprising graphite powder in which particle surfaces were coated with aluminum dihydrogen phosphate.

Figure 2:
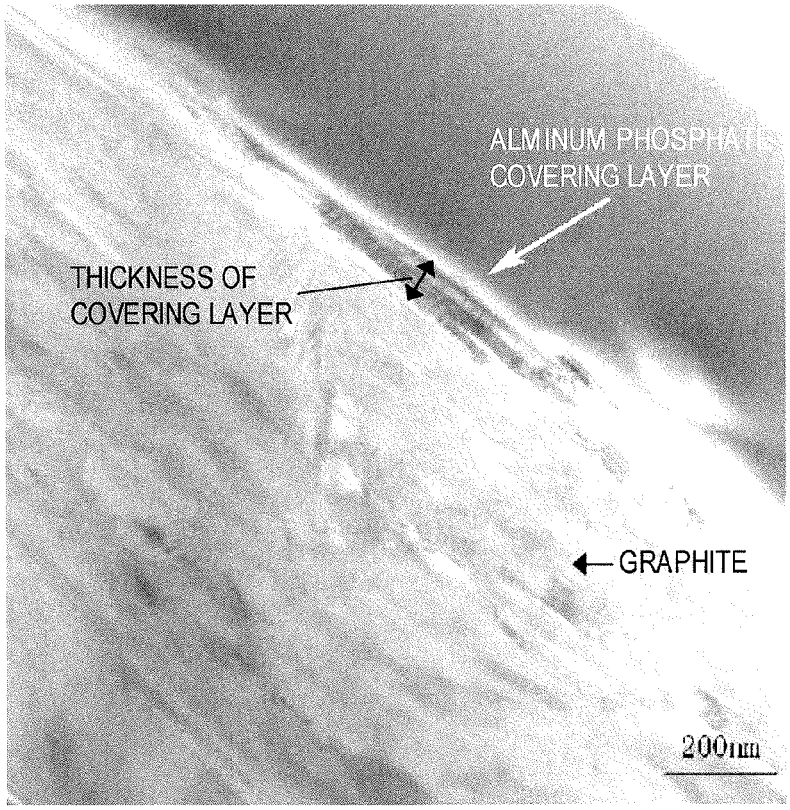
FIG. 2 is a TEM photograph of a solid lubricant obtained in Example 1.

A transmission electron microscope (TEM) photograph of this solid lubricant is shown in FIG. 2, Incidentally, the thickness of a phosphate covering layer was 50 nm.

EXAMPLES 2 to 4

In the same manner as in Example 1, aqueous solutions having aluminum dihydrogen phosphate concentrations of 0.5%, 5% and 10% by mass were prepared, and the artificial graphite (described above) was treated to obtain solid lubricants of Examples 2 to 4 comprising graphite powder in which particle surfaces were coated with aluminum dihydrogen phosphate.

EXAMPLE 5

A solid lubricant of Example 5 comprising graphite powder in which particle surfaces were coated with magnesium dihydrogen phosphate was obtained in the same manner as in Example 1 with the exception that an aqueous solution having a concentration of 1% by mass was prepared using magnesium dihydrogen phosphate in place of aluminum dihydrogen phosphate.

EXAMPLE 6

A solid lubricant of Example 6 comprising graphite powder in which particle surfaces were coated with aluminum dihydrogen phosphate and magnesium dihydrogen phosphate was obtained in the same manner as in Example 1 with the exception that a 1% by mass aqueous solution of a mixture of aluminum dihydrogen phosphate and magnesium dihydrogen phosphate was used in place of that of aluminum dihydrogen phosphate, A mass ratio of the mixture aluminum dihydrogen phosphate and magnesium dihydrogen phosphate was 8:2.

COMPARATIVE EXAMPLE 1

The artificial graphite used as the raw material in Examples 1 to 6 was used as such without being treated with the phosphate.

EXAMPLE 7

(1) Wet Pretreatment of Graphite

As untreated artificial graphite, artificial graphite manufactured by Tokai Carbon Co., Ltd. (trade name: "0152A", average particle size: 700 μm) was acid cleaned (the mixing ratio of graphite to phosphoric acid was 1:8.5 by mass ratio) for 5 minutes with phosphoric acid (manufactured by Wako Pure Chemical Industries, Ltd., concentration; 85,0% by mass or more), and washed twice with distilled water. Then, suction filtration was performed to obtain wet pretreated graphite.

(2) Coating of Wet Pretreated Graphite with Phosphate

Monobasic aluminum phosphate (aluminum dihydrogen phosphate (first grade) manufactured by Junsei Chemical Co., Ltd., form: powder) was mixed and dissolved in distilled water to prepare an aqueous solution (the concentration of aluminum dihydrogen phosphate to water was 0.5% by mass). This solution was mixed with the wet retreated graphite obtained in the above (1) to 7:3 by mass ratio, followed by stirring at an aqueous solution temperature of 50° C. for 1 hour by using a rotary vane stirrer (PM-203 manufactured by AS ONE Corporation). The resultant mixture was dried in the atmosphere at 110° C. for 24 hours and then cracked in a mortar, followed by heat treatment in vacuum at 800° C. for 3 hours. After the heat treatment, the cracked mixture was pulverized in a mortar to obtain a desired solid lubricant comprising graphite powder in which aluminum phosphate was bonded to and coated on a surface thereof.

EXAMPLES 8 to 10

The same operation as in Example 7 was performed with the exception that the concentration of aluminum dihydrogen phosphate to water was changed to 1%, 5% and 10% by mass in (2) of Example 7 to obtain three kinds of solid lubricants comprising graphite powder in which aluminum phosphate was bonded to and coated on a surface thereof.

Figure 3:
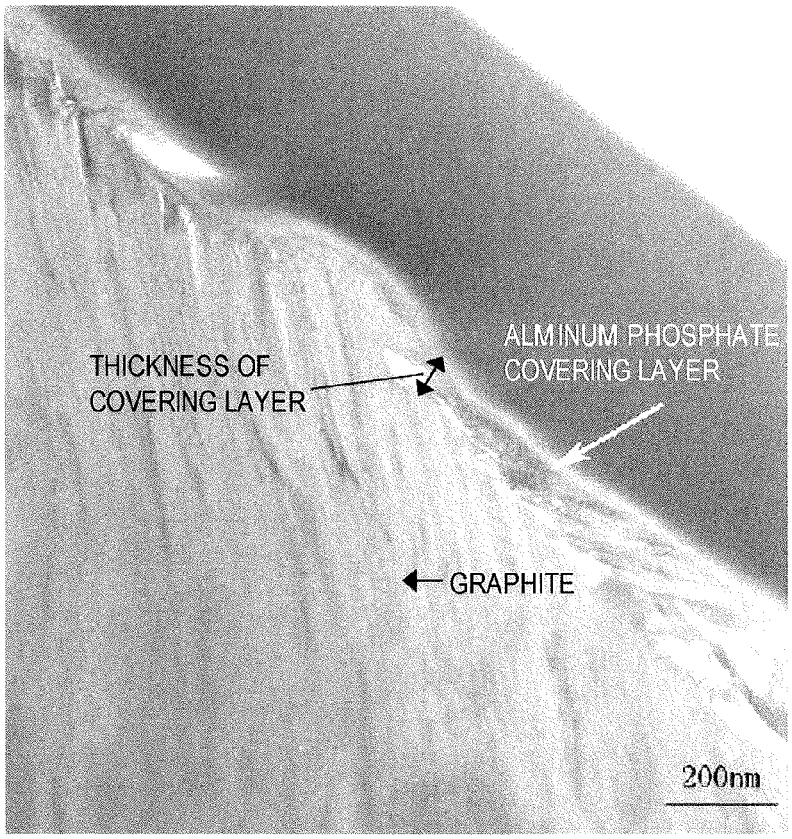
FIG. 3 is a TEM photograph of a solid lubricant obtained in Example 8.

A TEM photograph of the solid lubricant of Example 8 is shown in FIG. 3. Incidentally, the thickness of a phosphate covering layer was 50 nm.

EXAMPLE 11

(1) Dry Pretreatment of Graphite

The untreated artificial graphite particles used in Example 7 were placed on a vessel (made of stainless steel, with a ground), and irradiated with plasma using an atmospheric plasma generator. An embodiment of plasma irradiation is shown in FIG. 1.

As the plasma generator, "PS-601SW" manufactured by Wedge Co., Ltd. was used, and an atmospheric plasma treatment was performed on the artificial graphite particles under conditions of a distance between the plasma generating source and the artificial graphite particles of 80 mm and a treating time of 30 seconds to obtain dry pretreated graphite.

(2) Coating of Wet Pretreated Graphite with Phosphate

The same operation as in (2) of Example 7 was performed with the exception that the dry pretreated graphite of the above (1) was used to obtain a solid lubricant comprising graphite powder in which aluminum phosphate was bonded to and coated on a surface thereof.

EXAMPLES 12 to 14

The same operation as in Example 11 was performed with the exception that the concentration of aluminum dihydrogen phosphate to water was changed to 1%, 5% and 10% by mass in (2) of Example 7 to obtain three kinds of solid lubricants comprising graphite powder in which aluminum phosphate was bonded to and coated on a surface thereof.

EXAMPLE 15

The same operation as in Example 7 was performed with the exception that magnesium dihydrogen phosphate tetrahydrate was used in place of aluminum dihydrogen phosphate in (2) of Example 7 to obtain a solid lubricant comprising graphite powder in which magnesium phosphate was bonded to and coated on a surface thereof.

EXAMPLES 16 to 18

The same operation as in Example 15 was performed with the exception that the concentration of magnesium dihydrogen phosphate to water was changed to 1%, 5% and 10% by mass to obtain three kinds of solid lubricants comprising graphite powder in which magnesium phosphate was bonded to and coated on a surface thereof.

EXAMPLE 19

The same operation as in Example 7 was performed with the exception that an aqueous solution of aluminum dihydrogen phosphate and magnesium dihydrogen phosphate at a ratio of 8:2 by mass ratio having a concentration of 0.5% by mass to water was used in place of the aqueous solution of aluminum dihydrogen phosphate having a concentration of 0.5% by mass to water in (2) of Example 7 to obtain a solid lubricant comprising graphite powder in which aluminum phosphate and magnesium phosphate were bonded to and coated on a surface thereof.

EXAMPLES 20 to 22

The same operation as in Example 19 was performed with the exception that the concentration of the total amount of aluminum dihydrogen phosphate and magnesium dihydrogen phosphate to water was changed to 1%, 5% and 10% by mass to obtain three kinds of solid lubricants comprising graphite powder in which aluminum phosphate and magnesium phosphate were bonded to and coated on a surface thereof.

For the solid lubricants of Examples 1 to 6 and the untreated graphite sample of Comparative Example 1 described above, the resistance to thermal decomposition was evaluated by TG-DTA (thermogravimetric-differential thermal analysis) under conditions of 1,200° C. in the atmosphere. The results thereof are shown in Table 1.

TABLE 1

| CONDITION | KIND OF PHOSPHATE | PERCENT CONCENTRATION OF PHOSPHATE BY MASS | RESISTEANCE TO THERMAL DECOMPOSITION (TG) WEIGHT REDUCTION ONSET TEMPERATURE (° C.) | WEIGHT REDUCTION END TEMPERATURE (° C.) |
|---|---|---|---|---|
| EXAMPLE 1 | ALMINUM DIHYDROGEN PHOSPHATE | 1 | 777 | 1195 |
| EXAMPLE 2 | | 0.5 | 770 | 1180 |
| EXAMPLE 3 | | 5 | 791 | 1170 |
| EXAMPLE 4 | | 10 | 825 | 1160 |
| EXAMPLE 5 | MAGNESIUM DIHYDROGEN PHOSPHATE | 1 | 730 | 1120 |
| EXAMPLE 6 | ALMINUM DIHYDROGEN PHOSPHATE + MAGNESIUM DIHYDROGEN PHOSPHATE (MASS RATIO 8:2) | 1 | 760 | 1167 |
| COMPARATIVE EXAMPLE 1 | NOT COATED | 0 | 685 | 1077 |

[NOTICE] NO PRETREATMENT FOR GRAPHITE MATERIAL

From Table 1, it is apparent that the solid lubricants obtained in Examples 1 to 6 are about 100° C. improved in thermal resistance compared to the untreated artificial graphite of Comparative Example 1, and are excellent in thermal resistance. The reason for this is considered to be that the graphite surface is activated to increase bonds thereof with the aqueous solution of aluminum dihydrogen phosphate and/or magnesium dihydrogen phosphate, thereby forming the dense film.

Incidentally, a TG-DTA apparatus and measuring conditions are as follows:

Analysis equipment thermogravimetric-differential thermal analysis (TG-DTA) 2000S manufactured by Mac Science Co., Ltd.

Conditions: room temperature to 1,200° C., in the atmosphere, 10° C./min

Then, using the solid lubricants obtained in Examples 1 to 6 and the untreated graphite of Comparative Example 1, friction-material-forming materials were prepared by mixing the respective compositions by means of a mixer according to the compounding compositions shown in Table 2.

TABLE 2

| SOURCE | AMOUNT OF COMPOSITION (MASS PARTS) EXAMPLES 1 TO 6 | COMPARATIVE EXAMPLE 1 |
|---|---|---|
| PHENOL RESIN | 8 | 8 |
| CASHEW DUST | 4 | 4 |
| GUM DUST | 4 | 4 |
| BARIUM SULPHATE | 30 | 30 |
| ZIRCONIA | 2 | 2 |
| IRON OXIDE | 7 | 7 |
| UNTREATED GRAPHITE | 0 | 6 |
| SOLID LUBRICANT OF THE PRESENT INVENTION | 6 | 0 |
| ARAMID PULP | 4 | 4 |
| POTASSIUM TITANATE | 20 | 20 |
| CERAMIC FIBER | 3 | 3 |
| COPPER FIBER | 12 | 12 |

These friction-material-forming materials were each put in a preform die, and pressurized at ordinary temperature under 30 MPa to perform preforming. Subsequently, each of the resultant preforms and a pressure plate previously coated with an adhesive were set to a hot forming die, and hot pressure forming was performed at 200° C. under 50 MPa for 600 seconds. After the hot forming, heating was performed at 300° C. for 3 hours to obtain friction material samples.

For these friction material samples, a wear test was conducted under test conditions based on JASO 0403 and shown in Table 3 to measure the wear amount of friction material and the wear amount of rotor.

TABLE 3

| | INITIAL VELOCITY (km/h) | DECELERATION ($m/s^2$) | BRAKING ONSET TEMPERATURE (° C.) | BRAKING FREQUENCY (TIMES) |
|---|---|---|---|---|
| BURNISH | 50 | 2.94 | 100 | 100 |
| ELEVATED TEMPERATURE | 80 | 2.94 | 500 | 10 |
| 500° C. WEAR | 80 | 2.94 | 500 | 200 |

The results thereof are shown in Table 4.

TABLE 4

| | | | WEAR RESISTANCE | |
|---|---|---|---|---|
| CONDITION | KIND OF PHOSPHATE | PERCENT CONCENTRATION OF PHOSPHATE BY MASS | WEAR AMOUNT OF FRICTION MATERIAL (mm)[1] | WEAR AMOUNT OF ROTOR (μm)[2] |
| EXAMPLE 1 | ALMINUM DIHYDROGEN PHOSPHATE | 1 | 5.1 | −2.3 |
| EXAMPLE 2 | | 0.5 | 8.9 | −3.1 |
| EXAMPLE 3 | | 5 | 7.6 | −3.2 |
| EXAMPLE 4 | | 10 | 9.7 | −3.0 |
| EXAMPLE 5 | MAGNESIUM DIHYDROGEN PHOSPHATE | 1 | 6.7 | −2.8 |
| EXAMPLE 6 | ALMINUM DIHYDROGEN PHOSPHATE + MAGNESIUM DIHYDROGEN PHOSPHATE (MASS RATIO 8:2) | 1 | 6.0 | −2.1 |
| COMPARATIVE EXAMPLE 1 | NOT COATED | 0 | 10.3 | −3.2 |

[1]AVERAGE OF WEAR AT 1000 TIMES OF BRAKE

[2]MINUS SIGN MEANS TRANSFER OF FRICTION MATERIAL

From Table 4, the following has become clear.

It has been confirmed that the friction materials of Examples 1 to 6 obtained by using the solid lubricants obtained by treating the artificial graphite with the aqueous solutions of aluminum dihydrogen phosphate and/or magnesium dihydrogen phosphate decrease in the wear amount of friction material and the wear amount of rotor, compared to the friction material of Comparative Example 1 obtained by using the untreated graphite.

Then, specifications of the graphite samples in Examples 7 to 22 are shown in Table 5, Further, for the solid lubricants obtained in Examples 7 to 22 described above, the resistance to thermal decomposition was evaluated in the same manner as in Example 1 to 6 described above.

TABLE 5

| CONDITION | EXAMPLE 7 | EXAMPLE 8 | EXAMPLE 9 | EXAMPLE 10 | EXAMPLE 11 | EXAMPLE 12 | EXAMPLE 13 | EXAMPLE 14 |
|---|---|---|---|---|---|---|---|---|
| KIND OF PHOSPHATE | ALMINUM DIHYDROGEN PHOSPHATE | | | | | | | |
| PERCENT CONCENTRATION OF PHOSPHATE BY MASS | 0.5 | 1 | 5 | 10 | 0.5 | 1 | 5 | 10 |
| PRETREATMENT OF PHOSPHATE TREATMENT | ACID CLEANING (PHOSPHORIC ACID) | | | | ATMOSPHERIC PLASMA TREATMENT | | | |

| CONDITION | EXAMPLE 15 | EXAMPLE 16 | EXAMPLE 17 | EXAMPLE 18 | EXAMPLE 19 | EXAMPLE 20 | EXAMPLE 21 | EXAMPLE 22 |
|---|---|---|---|---|---|---|---|---|
| KIND OF PHOSPHATE | MAGNESIUM DIHYDROGEN PHOSPHATE | | | | ALMINUM DIHYDROGEN PHOSPHATE + MAGNESIUM DIHYDROGEN PHOSPHATE (MASS RATIO 8:2) | | | |
| PERCENT CONCENTRATION OF PHOSPHATE BY MASS | 0.5 | 1 | 5 | 10 | 0.5 | 1 | 5 | 10 |
| PRETREATMENT OF PHOSPHATE TREATMENT | ACID CLEANING (PHOSPHORIC ACID) | | | | ACID CLEANING (PHOSPHORIC ACID) | | | |

The results thereof are shown in Table 6.

TABLE 6

| CONDITION | | EXAMPLE 7 | EXAMPLE 8 | EXAMPLE 9 | EXAMPLE 10 | EXAMPLE 11 | EXAMPLE 12 | EXAMPLE 13 | EXAMPLE 14 |
|---|---|---|---|---|---|---|---|---|---|
| KIND OF PHOSPHATE | | ALMINUM DIHYDROGEN PHOSPHATE | | | | | | | |
| PERCENT CONCENTRATION OF PHOSPHATE BY MASS | | 0.5 | 1 | 5 | 10 | 0.5 | 1 | 5 | 10 |
| PRETREATMENT OF PHOSPHATE TREATMENT | | ACID CLEANING (PHOSPHORIC ACID) | | | | ATMOSPHERIC PLASMA TREATMENT | | | |
| THERMAL RESISTENCE (TG) | WEIGHT REDUCTION ONSET TEMPERATURE (° C.) | 780 | 797 | 811 | 825 | 778 | 798 | 809 | 823 |
| | WEIGHT REDUCTION END TEMPERATURE (° C.) | 1190 | 1210 | 1180 | 1167 | 1190 | 1214 | 1179 | 1165 |
| WEAR RESISTENCE | WEAR AMOUNT OF FRICTION MATERIAL (mm)[1] | 8.5 | 4.7 | 7.3 | 9.7 | 8.4 | 4.7 | 7.3 | 9.7 |
| | WEAR AMOUNT OF ROTOR (μm)[2] | −2.7 | −2.2 | −3.1 | −3.0 | −2.6 | −2.2 | −3.1 | −3.1 |

| CONDITION | | EXAMPLE 15 | EXAMPLE 16 | EXAMPLE 17 | EXAMPLE 18 | EXAMPLE 19 | EXAMPLE 20 | EXAMPLE 21 | EXAMPLE 22 |
|---|---|---|---|---|---|---|---|---|---|
| KIND OF PHOSPHATE | | MAGNESIUM DIHYDROGEN PHOSPHATE | | | | ALMINUM DIHYDROGEN PHOSPHATE + MAGNESIUM DIHYDROGEN PHOSPATE (MASS RATE 8:2) | | | |
| PERCENT CONCENTRATION OF PHOSPHATE BY MASS | | 0.5 | 1 | 5 | 10 | 0.5 | 1 | 5 | 10 |
| PRETREATMENT OF PHOSPHATE TREATMENT | | ACID CLEANING (PHOSPHORIC ACID) | | | | ACID CLEANING (PHOSPHORIC ACID) | | | |
| THERMAL RESISTENCE (TG) | WEIGHT REDUCTION ONSET TEMPERATURE (° C.) | 741 | 751 | 761 | 772 | 770 | 780 | 788 | 795 |
| | WEIGHT REDUCTION END TEMPERATURE (° C.) | 1128 | 1138 | 1137 | 1102 | 1177 | 1187 | 1162 | 1132 |
| WEAR RESISTENCE | WEAR AMOUNT OF FRICTION MATERIAL (mm)[1] | 8.6 | 6.4 | 8.2 | 10.1 | 8.6 | 5.5 | 8.1 | 9.9 |
| | WEAR AMOUNT OF ROTOR (μm)[2] | −2.9 | −2.5 | −3.7 | −3.7 | −3.1 | −2.0 | −3.6 | −3.6 |

[1]AVERAGE OF WEAR AT 1000 TIMES OF BRAKE
[2]MINUS SIGN MEANS TRANSFER OF FRICTION MATERIAL

Furthermore, using the solid lubricants of Examples 7 to 22, friction-material-forming materials were prepared by mixing the respective compositions by means of a mixer according to the compounding compositions of Examples 1 to 6 shown in Table 2. Using these friction-material-forming materials, the same operation as in Examples 1 to 6 was performed to obtain friction material samples, For these friction material samples, the wear test was conducted under the test conditions based on JASO C403 and shown in Table 3 to measure the wear amount of friction material and the wear amount of rotor. The results thereof are shown in Table 6.

From Tables 1, 4 and 6 described above, when Examples in which the graphite has not been pretreated are compared to Examples in which the graphite has been pretreated, under conditions in which the kind and concentration of phosphate are the same, the solid lubricants pretreated by the acid treatment or the atmospheric plasma treatment are all excellent in the resistance to thermal decomposition, and small in the wear amount of friction material and the wear amount of rotor, within a phosphate concentration range of 0.5 to 5% by mass, compared to the solid lubricants not pretreated.

The solid lubricant of the invention is more significantly improved in thermal resistance and oxidation resistance than graphite and enhanced in lubricating performance at high temperature, so that it is suitably used in a non-asbestos brake friction material, a sliding component or the like.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

What is claimed is:

1. A solid lubricant comprising:

a graphite material coated with a phosphate, wherein the graphite material coated with the phosphate has a phosphate covering layer having a thickness of 5 to 500 nm on a particle surface thereof.

2. The solid lubricant as set forth in claim 1, wherein the phosphate is at least one selected from the group consisting of an aluminum phosphate, a magnesium phosphate, a calcium phosphate, a potassium phosphate, a sodium phosphate and a zinc phosphate.

3. A method for producing a solid lubricant, comprising:

preparing a phosphate aqueous solution which contains at least one of aluminum dihydrogen phosphate and magnesium dihydrogen phosphate in an amount of 0.5 to 10% by mass; and coating a graphite material with a phosphate using the phosphate aqueous solution, wherein the graphite material is used at a ratio of 40 to 50 parts by mass based on 100 parts by mass of the aqueous solution, the graphite material is previously pretreated by a wet method comprising a washing treatment with an acid.

4. A method for producing a solid lubricant, comprising:

preparing a phosphate aqueous solution which contains at least one of aluminum dihydrogen phosphate and magnesium dihydrogen phosphate in an amount of 0.5 to 10% by mass; and coating a graphite material with a phosphate layer having a thickness of 5 to 500 nm using the phosphate aqueous solution, wherein the graphite material is used at a ratio of 40 to 50 parts by mass based on 100 parts by mass of the aqueous solution, the graphite material is previously pretreated by a wet method or a dry method, and the pretreatment by the dry method is an atmospheric plasma treatment.

5. A non-asbestos brake friction material comprising the solid lubricant as described in claim 1.

6. A sliding component comprising the solid lubricant as described in claim 1.

* * * * *